US007721471B2

(12) United States Patent
Gamble, II

(10) Patent No.: US 7,721,471 B2
(45) Date of Patent: May 25, 2010

(54) SNOW PLOW DEFLECTOR

(75) Inventor: Robert N. Gamble, II, Watertown, WI (US)

(73) Assignee: Sno-Way International, Inc., Hartford, WI (US)

( * ) Notice: Subject to any disclaimer, the term of this patent is extended or adjusted under 35 U.S.C. 154(b) by 35 days.

(21) Appl. No.: 12/062,198

(22) Filed: Apr. 3, 2008

(65) Prior Publication Data

US 2009/0249659 A1 Oct. 8, 2009

(51) Int. Cl.
*E01H 5/06* (2006.01)

(52) U.S. Cl. ..... 37/275

(58) Field of Classification Search ..... 37/275, 37/273, 281, 260, 266, 233; 172/112; 280/770; 296/152; 293/115; 267/136, 90, 195, 276, 267/282

See application file for complete search history.

(56) References Cited

U.S. PATENT DOCUMENTS

| | | | | | |
|---|---|---|---|---|---|
| 1,926,011 | A * | 9/1933 | Soule | 37/275 |
| 3,526,979 | A * | 9/1970 | Ladewski | 37/273 |
| 3,863,728 | A * | 2/1975 | Mittendorf | 180/68.6 |
| 4,385,458 | A * | 5/1983 | Pitti | 37/281 |
| 4,459,769 | A * | 7/1984 | Willis, Sr. | 37/275 |
| 4,574,502 | A * | 3/1986 | Blau | 37/266 |
| 4,878,704 | A * | 11/1989 | Jacanin et al. | 294/54.5 |
| 4,899,472 | A * | 2/1990 | Winter | 37/270 |
| 4,929,013 | A * | 5/1990 | Eke | 296/91 |
| 4,936,599 | A * | 6/1990 | McNamee | 280/770 |
| 5,048,207 | A * | 9/1991 | Verseef | 37/281 |
| 5,636,458 | A * | 6/1997 | Drake | 37/270 |
| 6,018,894 | A * | 2/2000 | Whitehead et al. | 37/285 |
| 6,672,651 | B1 * | 1/2004 | Shuen | 296/180.5 |
| 7,083,002 | B2 * | 8/2006 | Matsumoto et al. | 172/822 |
| 2001/0005949 | A1 * | 7/2001 | Amano et al. | 37/381 |
| 2001/0040383 | A1 * | 11/2001 | Lund et al. | 296/95.1 |
| 2004/0250454 | A1 * | 12/2004 | Jager | 37/266 |
| 2006/0185199 | A1 * | 8/2006 | Watros | 37/231 |
| 2008/0179914 | A1 * | 7/2008 | Wegener | 296/180.1 |
| 2008/0277966 | A1 * | 11/2008 | Vlahovic | 296/180.1 |

* cited by examiner

*Primary Examiner*—Thomas B Will
*Assistant Examiner*—Abigail A Risic
(74) *Attorney, Agent, or Firm*—Reinhart Boerner Van Deuren s.c.

(57) ABSTRACT

A snow plow deflector for a straight snow plow blade is provided including a center section having a plurality of spaced-apart recesses formed therein, and two outer sections, each also having a plurality of spaced-apart recesses formed therein, wherein each of the outer sections are positioned to align with opposite side edges of the snow plow blade, respectively, with the center section secured thereover such that the recesses of the center section interfit and seat within the recesses of the outer portions and secure thereto. The plurality of recesses provided along the width of each deflector section permits the overall width of the deflector to be adjusted to fit a variety of snow plow blade widths.

11 Claims, 8 Drawing Sheets

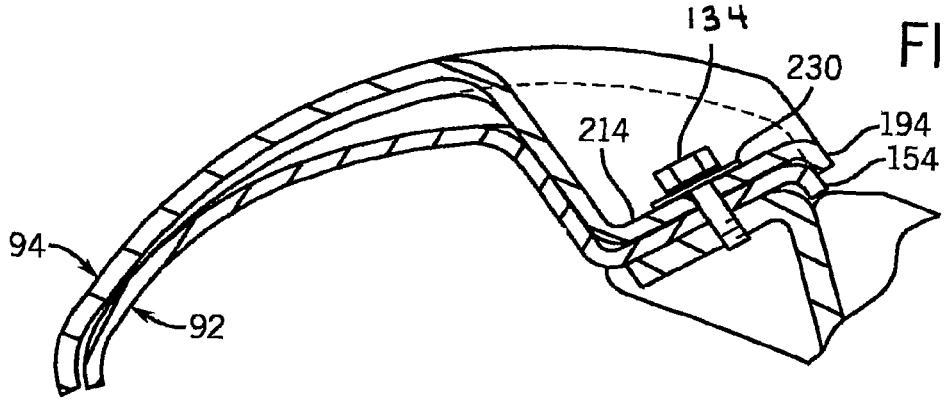
FIG. 15
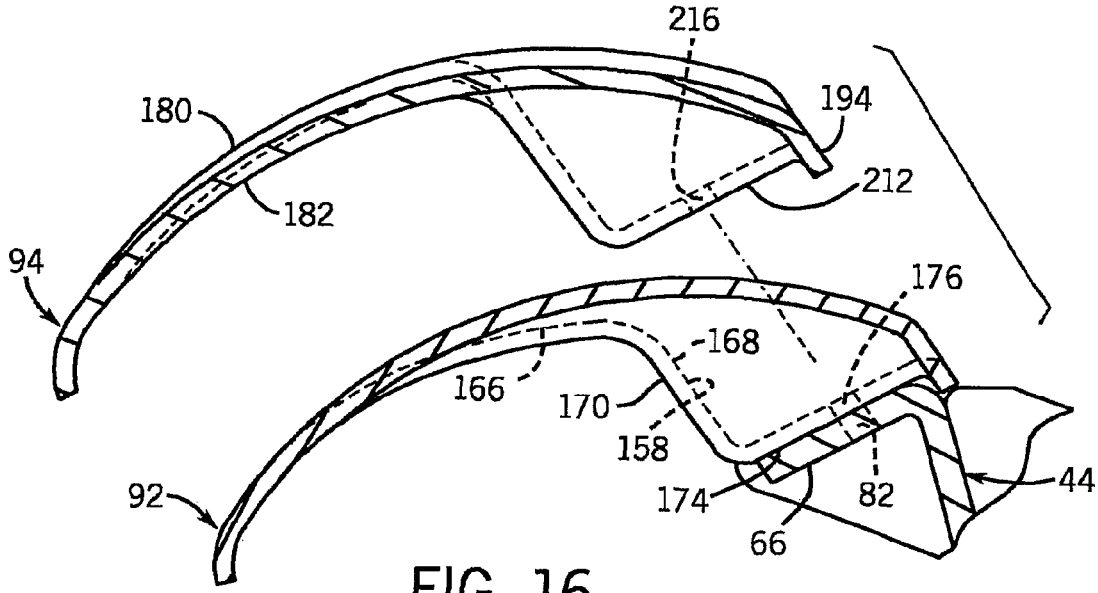
FIG. 16
FIG. 17
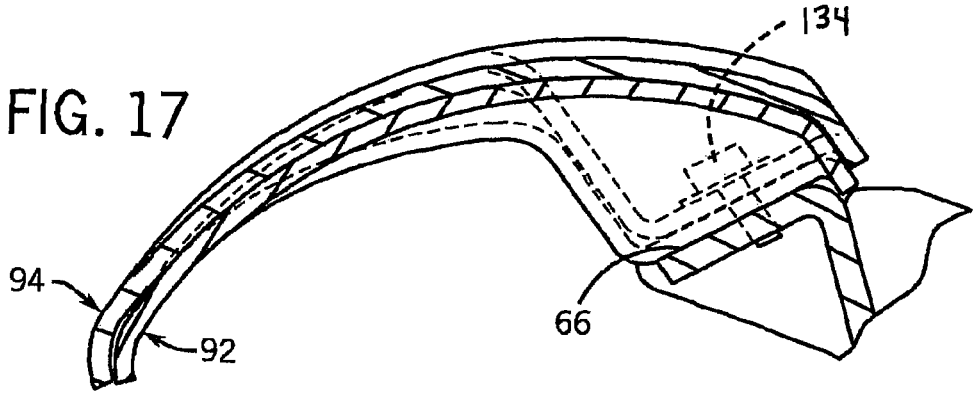

SNOW PLOW DEFLECTOR

BACKGROUND OF THE INVENTION

Field of the Invention

The present invention relates generally to snow plows typically used with light and medium duty trucks, and particularly to a straight blade snow plow deflector for use with a straight blade snow removal system.

Once the exclusive domain of municipality-operated heavy trucks, snow plows have been used with light and medium duty trucks for decades. As would be expected in any area of technology which has been developed for that period of time, snow plows for light and medium duty trucks have undergone tremendous improvement in a wide variety of ways over time, evolving to increase both the usefulness of the snow plows as well as to enhance the ease of using them. The business of manufacturing snow plows for light and medium duty trucks has been highly competitive, with manufacturers of competing snow plows differentiating themselves based on the features and enhanced technology that they design into their products.

One of the most common types of snow plow designs includes a snow plow blade that is straight or substantially linear along its width dimension having a rolled or curved moldboard. This type of plow blade is secured to the front end of the plow vehicle, and can be operated in a straight position or can be pivoted left or right about a central axis to push snow to either side of the vehicle.

However, a straight blade plow can have difficulty pushing large amounts of snow to an out of the way location. For example, when moving larger piles of snow, snow typically spills over the top edge of the blade and falls back on to the just-plowed surface. In addition, at high rates of speed, snow is sprayed over the top of the snow plow blade and on to the windshield of the snow plow vehicle, interfering with the driver's visibility, and the safety of the operation of the snow plow.

Snow plow blade deflector can be added to a conventional straight blade snow plow design, however, many of the available prior art deflectors come in a single width or size, and therefore cannot be used on more than one snow plow blade. As a result, many different widths of deflectors must be manufactured to accommodate the available blade widths, and consumers must purchase a different defector for each plow.

In addition, conventional after market deflectors require specialized mounting equipment, such as mounting frames, bars and hardware that mount behind the snow plow blade, which lack the rigidity to withstand heavy and/or wet snow. Further, such equipment adds weight to the snow plow, adding stress to the hydraulic lifting system of the snow plow, requiring more force to move the blades into position for plowing. The additional weight or mass of the snow plow blade can adversely affect fuel economy, handling of the snow plow and the useful life of the snow plow vehicle.

Accordingly, a straight snow plow blade snow deflector that can be adjusted to fit a wide range of sizes of snow plow blades, without adding significant additional weight to the snow plow blade and without requiring cumbersome mounting equipment is needed to address the problems of conventional snow deflectors.

The straight blade snow plow snow deflector of the present invention must also be of construction which is both durable and long lasting, and it should also require little or no maintenance to be provided by the user throughout its operating lifetime. In order to enhance the market appeal of the snow plow of the present invention, it should also be of inexpensive construction to thereby afford it the broadest possible market. Finally, it is also an objective that all of the aforesaid advantages and objectives of the snow plow having reinforced wings of the present invention be achieved without incurring any substantial relative disadvantage.

SUMMARY OF THE INVENTION

The disadvantages and limitations of the background art discussed above are overcome by the present invention. With this invention, a snow plow deflector for a straight snow plow blade is provided.

A conventional straight snow plow blade has a front, plowing side and a rear side that will be secured to the plow vehicle during operation of the snow plow. The overall width of a straight snow plow blade depends on the particular application of the snow plow, the manufacturer and/or the particular model of snow plow and is a matter of choice. Widths can vary from about six feet to about ten feet, or even longer depending on the application.

The snow plow blade has a support frame including a substantially arcuate overall cross-section and a moldboard secured to the front, plowing side thereof. The typical support frame of a straight snow plow blade includes a top, substantially horizontal mounting surface. The mounting surface of the snow plow blade is preferably provided with a plurality of evenly spaced apertures or pre-tapped holes along the width thereof. Alternatively, the holes may be provided at the time of installation of the snow deflector of the present invention.

It will be further appreciated that the snow deflector of the present invention can be secured to a number of different types of straight snow plow blades provided that the snow plow blade includes a top frame member having a mounting surface.

The snow deflector of the present invention has a generally arcuate cross section preferably and comprises three separate but interlocking components or pieces. The deflector preferably includes two outer sections and a center section. The snow deflector is preferably constructed of a plastic material such as polypropylene, polyethylene, polystyrene, silicones, polyurethanes, acrylics, rubber, synthetic rubber, neoprene, or combinations thereof. Most preferably, each piece of the snow deflector is constructed of High Molecular Weight Polyethylene (HMPE) to provide the deflector with an impact resistant, abrasion resistant and low friction plowing surface so that snow easily rolls off the deflector. Alternately, the rear-most portions of the deflector that are attached to the snow plow blade can have a steel reinforcement (not shown) located within the plastic material, while the unreinforced forward-most portions of the snow deflector will not be so reinforced and will accordingly be more flexible.

The outer sections are constructed in substantially identical manner, each having a generally arcuate cross section for moving snow outwardly and downwardly away from the snow plow blade. Each outer section includes a plurality of downwardly sloping channels and a corresponding plurality of recesses adjacent thereto that are formed in an evenly spaced manner along its entire width. Each channel forms a reinforcing rib on the opposite surface of the outer section. An aperture is formed in the bottom of each recess to accommodate a bolt or other fastening mechanism so that each outer section can be secured to the top member of the snow plow blade. The apertures are positioned within each recess so that they can be coaxially aligned with the apertures on the top member of the snow plow blade.

The center section also has a generally arcuate cross section and is substantially the same shape as the center sections. A plurality of raised ribs and a corresponding plurality of recesses are formed in an evenly spaced manner along the entire width of the center section. The ribs strengthen the center section to permit the deflector to withstand the impact of large or heavy loads of snow.

Each recess of the center section is sized to fit and seat flush within the recesses formed in the outer sections. An aperture is formed through the bottom of each of the recesses to accommodate the bolt. As will be appreciated, the apertures in the center section are positioned within each of the recesses so that they can be aligned with the apertures in the outer sections and also with the apertures on the top member of the snow plow blade.

The snow deflector of the present invention is installed on to the straight snow plow blade when the blade is in its lowered, substantially flat position. Each of the outer sections are aligned with and respectively secured to the top member of the snow plow blade.

The outer sections can be adjusted in either direction along the width of the snow plow blade so that each of the apertures formed in the bottom of each recess are coaxially aligned with the apertures in the top mounting surface of the snow plow blade. When the outer sections are in place, a portion of the top member of the straight snow plow blade is not covered by the deflector. Accordingly, the center section is positioned over the uncovered portion of the plow blade and over the top of both the outer sections, so that one of its side ends overlaps a portion of the outer section, and its opposite side end overlaps a portion of the other outer section.

When properly positioned, the recesses of the center section interfit and seat flush within the recesses in the overlapping portions of each of the outer sections. In addition, the apertures in the bottom of each seated recess of the center section are coaxially aligned with the corresponding apertures in the bottom of the outer sections, which are in turn, coaxially aligned with the apertures in the mounting surface of the top member of the snow plow blade. Bolts and washers are then used to secure the snow deflector to the snow plow blade.

The snow deflector of the present invention is adjustable to straight snow plow blades of different widths. For example, depending on the width of the snow plow blade, the ends of the center section will overlap a smaller, or larger portion of the outer sections. Accordingly, the number of recesses of the center section that overlap and seat within the correspondingly aligned recesses of the outer sections is determined by the width of the snow plow blade.

The snow plow deflector of the present invention is of a construction which is both durable and long lasting, and which will require little or no maintenance to be provided by the user throughout its operating lifetime. The snow plow deflector of the present invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which:

FIG. 15 is a partial view of the snow deflector illustrated in FIGS. 1 through 11 and 14, taken along the line 15-15 in FIG. 5, showing the center section aligned with the outer section and secured to the frame member of the snow plow blade with a bolt;

FIG. 16 is a partial view of the snow deflector illustrated in FIGS. 1 through 11, 14 and 15, taken along the line 16-16 in FIG. 5, showing an aperture of the center section aligned with an aperture of the outer section and also aligned with an aperture in the top frame member of the snow plow blade; and FIG. 17 is a partial view of the snow deflector illustrated in FIGS. 1 through 11 and 14 and 15 taken along the line 17-17 in FIG. 5, showing the center section aligned with the outer section and secured to the frame member of the snow plow blade.

DETAILED DESCRIPTION OF THE PREFERRED EMBODIMENT

Figure 1:
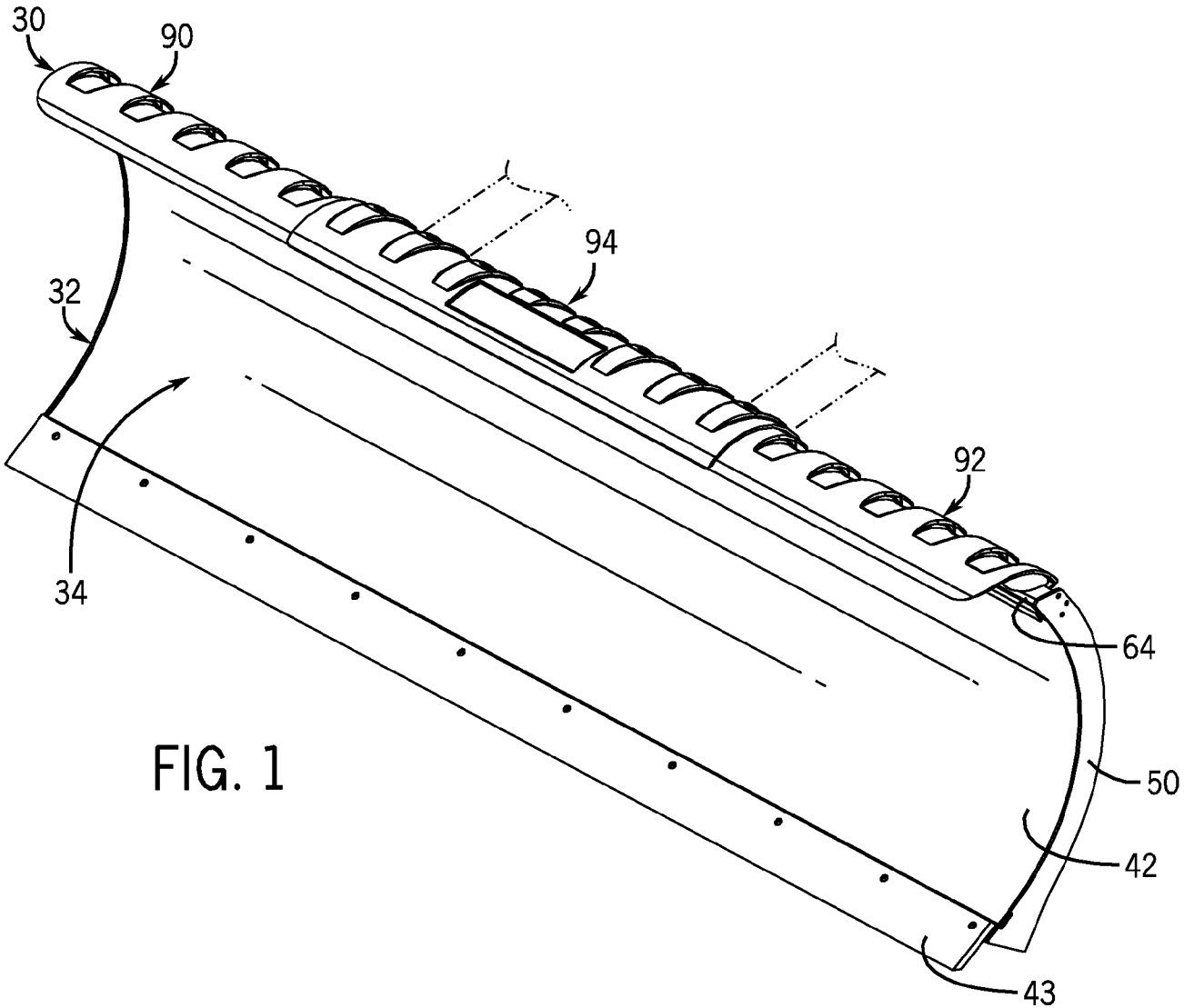
FIG. 1 is a front perspective view of a snow plow blade including a snow defector assembly of the present invention installed thereon.

A snow plow deflector 30 of the present invention is illustrated in FIGS. 1 through 17 and described with respect to a straight snow plow blade 32. The snow plow blade 32 has a front, plowing side 34 and a rear side 36 that will be secured to the plow vehicle (not shown) during operation of the snow plow. As illustrated in FIGS. 1 through 4, the snow plow blade 32 has an overall width 38, that will depend on the particular application of the snow plow, for example, a lighter duty plow may be shorter in width than a commercial plow, as well known in the art. The snow plow blade 32 includes, in its simplest form, a support frame, indicated generally at 40, having a substantially arcuate overall cross-section, an arcuate moldboard 42 and a wearstrip 43 secured to the front side 34 thereof.

The frame 40 comprises a top member 44, a bottom member 46 and vertical side members, indicated generally at 48 and 50, connecting the top and bottom members 44 and 46. The frame 40 can further include a plurality of support ribs 52, support plates 54 and cross members 56 positioned between the vertical side members 48 and 50 to reinforce the frame 40. Other optional elements such as brackets 58 for mounting support shoes to the frame 40 and/or brackets 60 for attaching the snow plow blade 32 to a hitch or vehicle mounting mechanism (not shown in the Figures) can also be included on the rear side 36 of the plow blade 32.

The top member 44 has a front surface 64, a top mounting surface 66, a rear surface 68, and first and second opposing ends 70 and 72. A front edge 78 and a rear edge 80 define the width 76 of the mounting surface 66. A plurality of apertures or holes 82 are provided in an evenly spaced manner between the ends 70 and 72 of the mounting surface 66 and are linearly arranged with respect to each other. The holes 82 may be pre-drilled in the mounting surface 66, or may be provided at the time of installation of the snow deflector 30. It will be appreciated that the top member 44 can be a hollow member, a solid member, a channel member, or any type of rigid structure presenting a top mounting surface capable of receiving the deflector 30, as described in more detail below.

Accordingly, it will be further appreciated that the snow deflector 30 of the present invention can not only be secured to snow plow blades of different widths, but can be secured to a number of different types of straight snow plow blades, provided the snow plow blade includes a top frame member having a mounting surface as described above. As such, the straight snow plow blade 30 and frame 40 configuration illustrated in FIGS. 1 through 17 is provided as an example of the type of straight snow plow blade utilized with the present invention.

Referring to FIGS. 5 and 12 through 17, in addition to FIGS. 1 through 4, the snow deflector 30 of the present invention preferably comprises three separate but interlocking components or pieces including two outer sections 90 and 92 and a center section 94. Although certain preferred embodiments of the present invention include the three component snow deflector 30, consistent with the broader aspects of the present invention, one skilled in the art will recognize that the snow deflector 30 can include more than three components, constructed in a like manner to the snow deflector 30 described herein.

The sections 90, 92, and 94 of the snow deflector 30 are preferably constructed of a plastic material such as polypropylene, polyethylene, polystyrene, silicones, polyurethanes, acrylics, rubber, synthetic rubber, neoprene, or combinations thereof. Most preferably, each piece of the snow deflector 30 is constructed of High Molecular Weight Polyethylene (HMPE) to provide the deflector 30 with a rigid and low friction plowing surface so that snow easily rolls off the deflector. Alternately, the rear-most portions of the deflector 30 that are attached to the snow plow blade can have a steel reinforcement (not shown) located within the plastic material, while the unreinforced forward-most portions of the snow deflector 30 will not be so reinforced and will accordingly be more flexible.

Figures 2, 3:
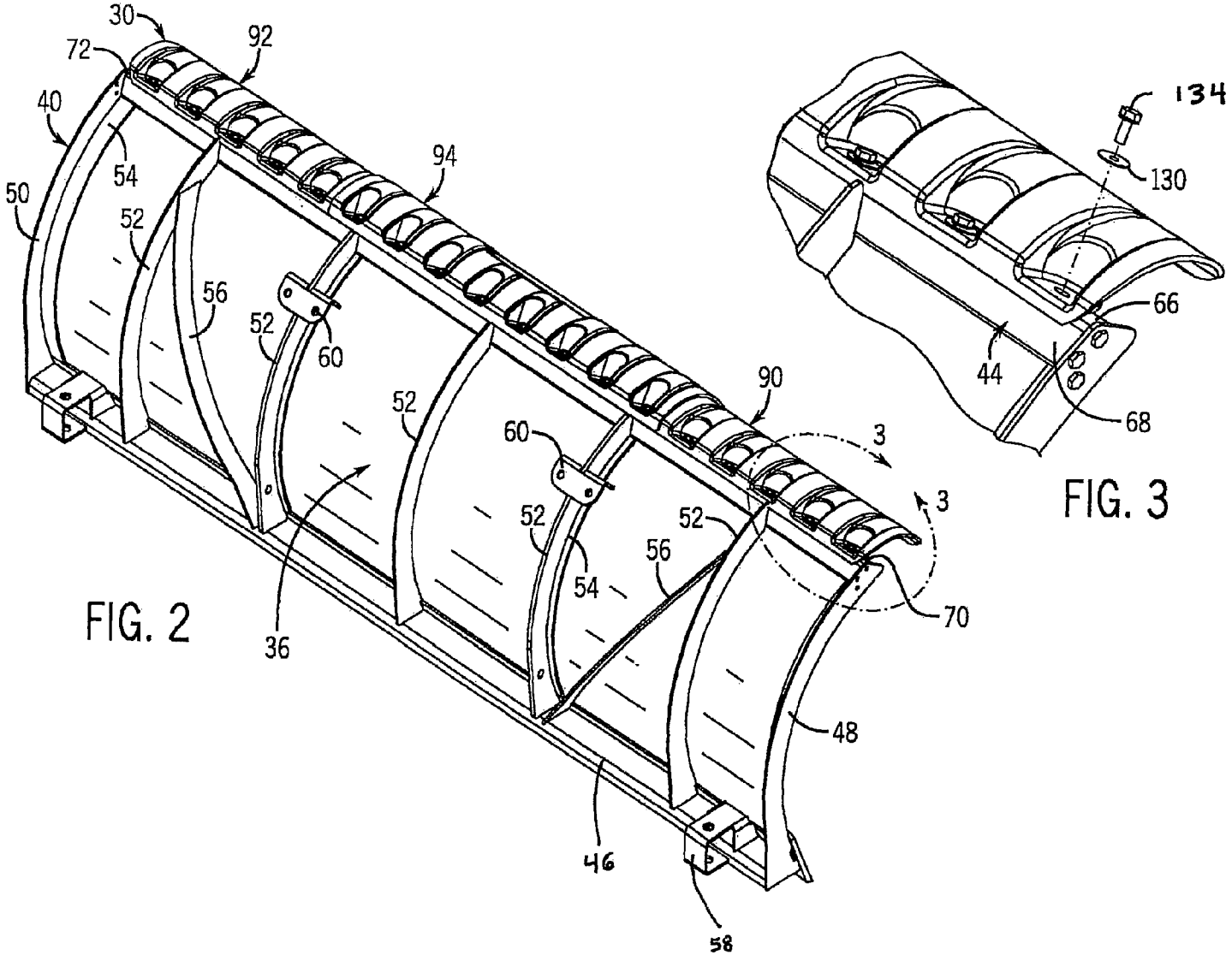
FIG. 2 is a rear perspective view the straight snow plow blade including the snow defector assembly illustrated in FIG. 1.
FIG. 3 is partial view of the snow plow deflector illustrated in FIG. 2 taken along the line 3-3 thereof, showing assembly of the snow deflector on to the frame of the snow plow blade.
Figure 4:
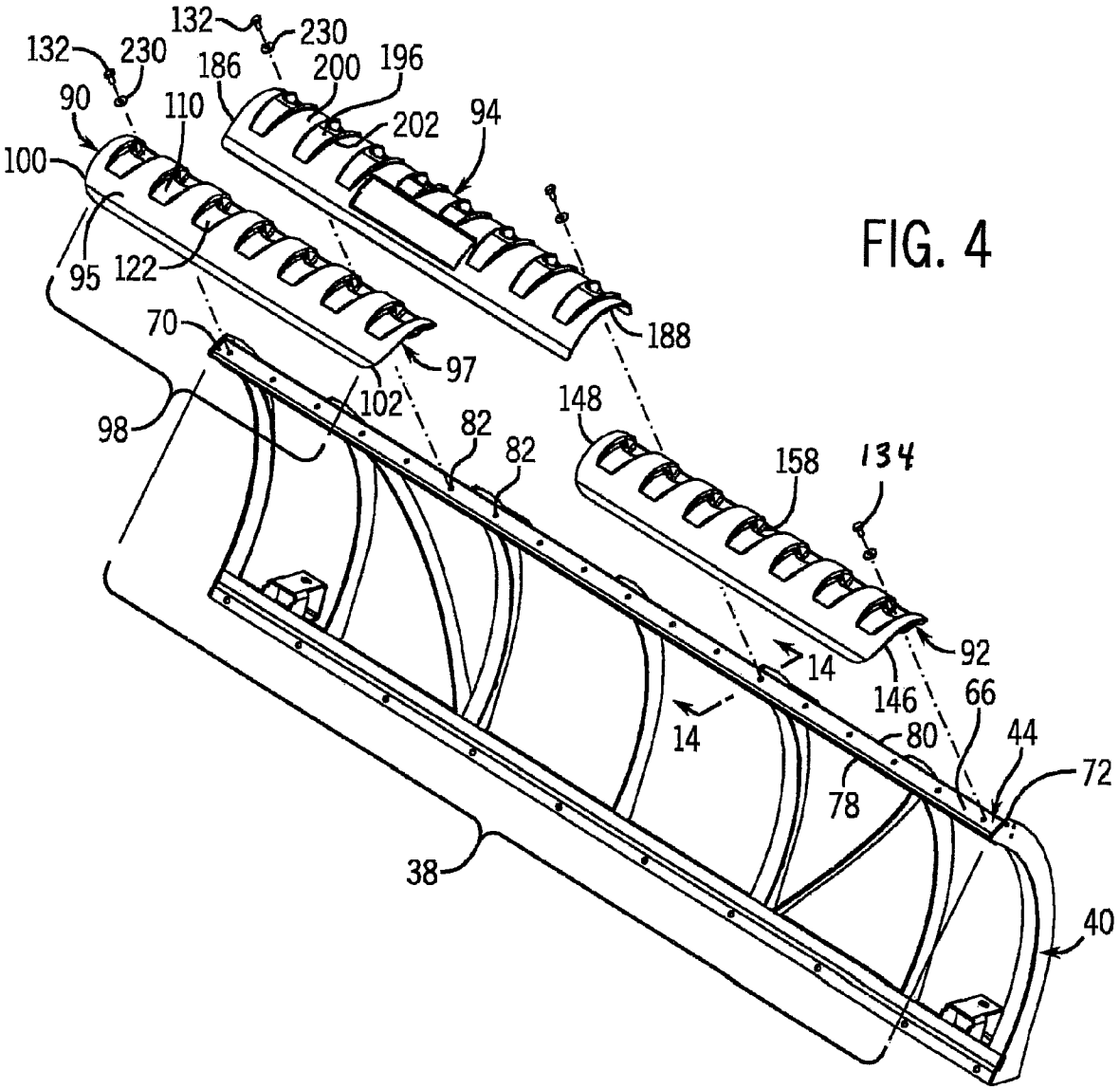
FIG. 4 is an exploded view of the snow deflector illustrated in FIGS. 1 through 3, showing assembly of each section of the snow deflector onto the frame of the snow plow blade.
Figure 5:
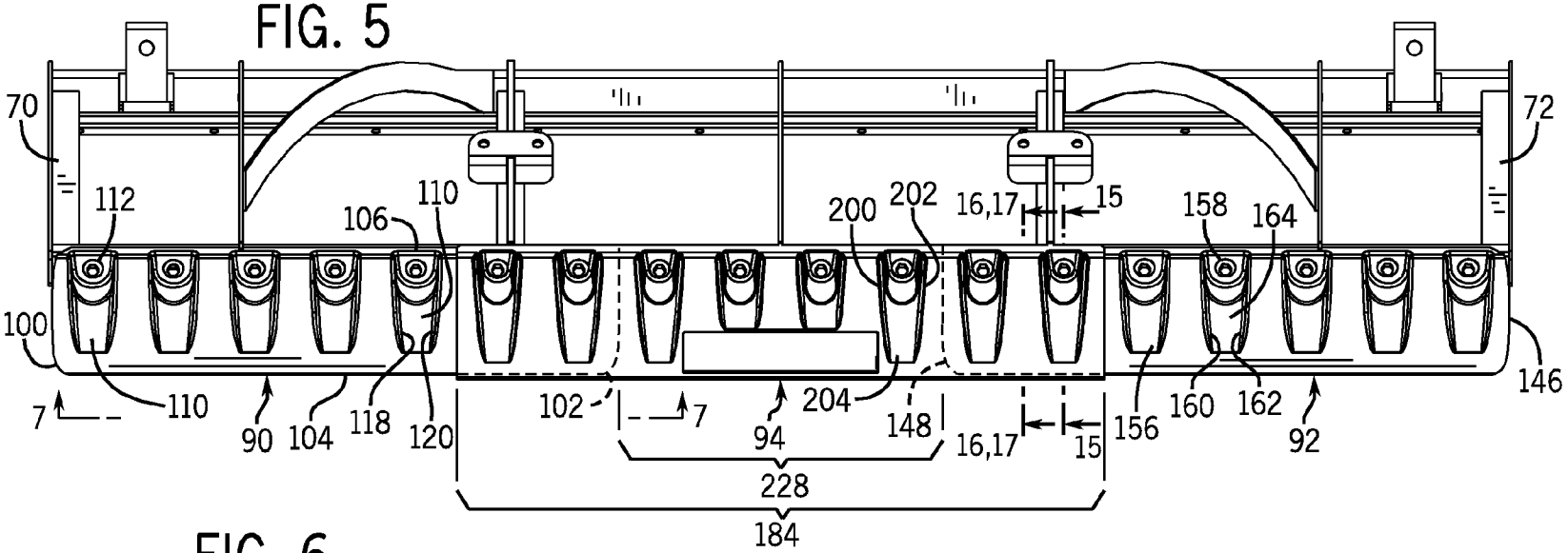
FIG. 5 is a top view of the snow deflector illustrated in FIGS. 1 through 4, showing the outer sections and center section of the snow deflector mounted onto the frame of the snow plow blade.
Figure 12:
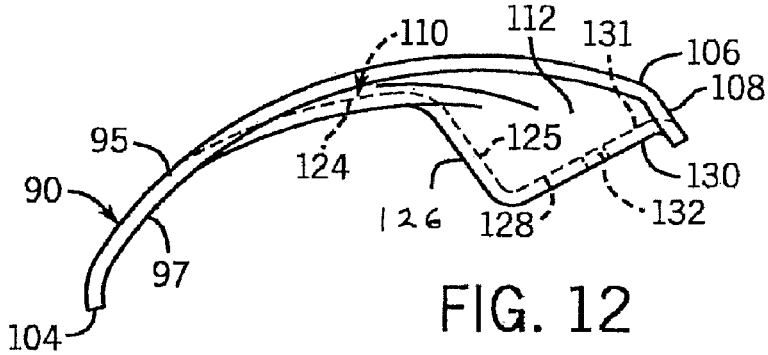
FIG. 12 is a side view of one of the outer sections of the snow plow deflector illustrated in FIGS. 1 through 11.
Figure 14:
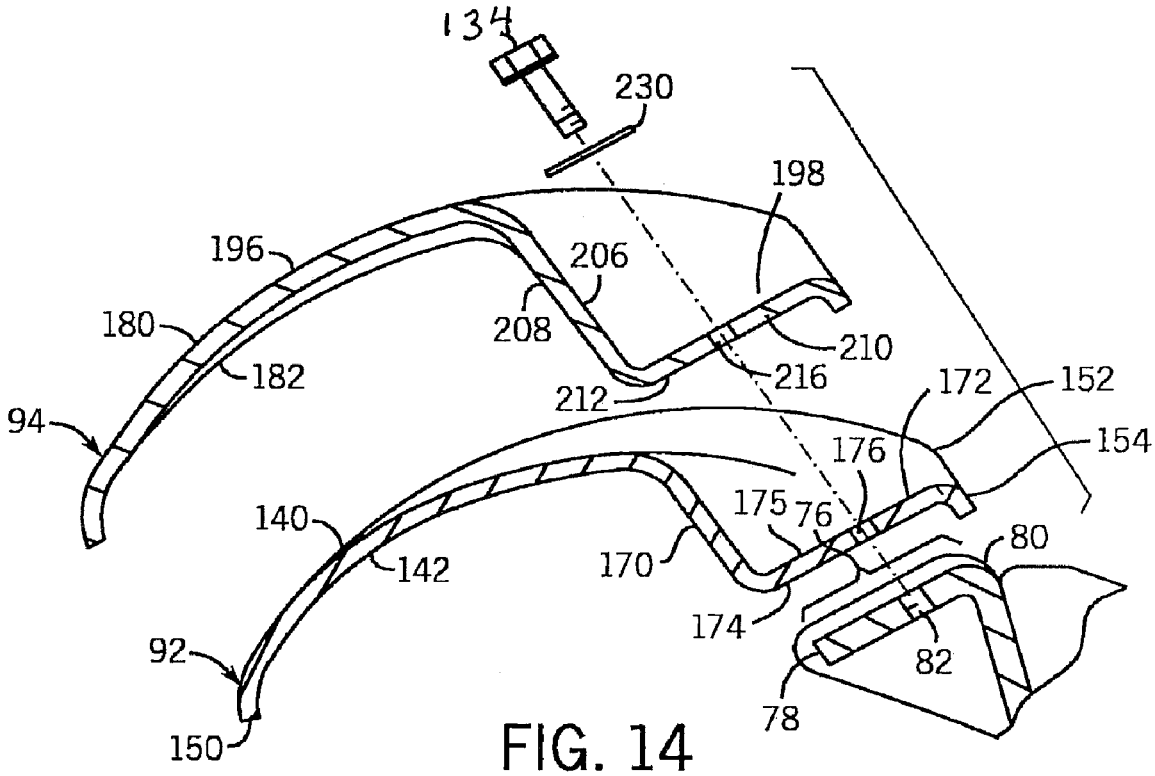
FIG. 14 is an exploded view of the snow deflector illustrated in FIGS. 1 through 11, taken along the line 14-14 in FIG. 4, showing assembly of the center section and outer section onto the frame of the snow plow blade.

As illustrated in FIGS. 2, 4, and 12, the outer section 90 has a generally arcuate cross section including first and second surfaces 95 and 97, a width 98 defined by first and second side ends 100 and 102, a forward edge 104, having a downwardly angled position and a rear edge 106 including a downwardly extending lip 108. A plurality of downwardly sloping channels 110 and a corresponding plurality of mounting elements 112, such as the recesses, are formed in an evenly spaced manner along the entire width 98 of the outer section 90 between the ends 100 and 102 thereof. As illustrated in FIGS. 4 and 5, each channel 110 is adjacent to one of the recesses 112.

Figure 7:
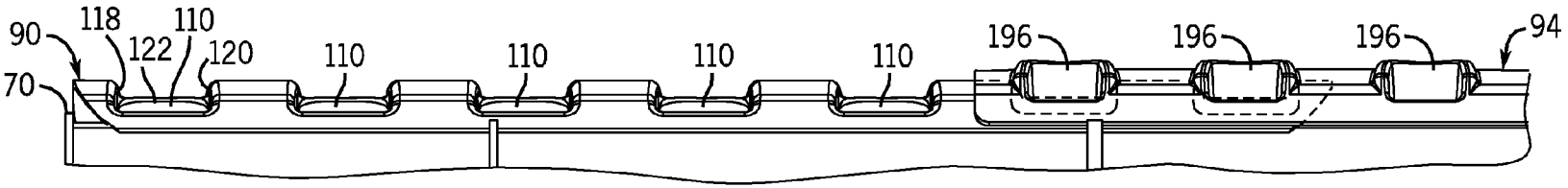
FIG. 7 is a partial side view of the snow deflector illustrated in FIGS. 1 through 6, taken along the line 7-7 in FIG. 5.

Each channel 110 begins near the forward edge 104 of the outer section 90 and includes first and second side walls 118 and 120 that slope downwardly toward the rear edge 106 and a ramp portion 122. As best illustrated in FIGS. 7 and 12, each of the channels 110 in the first surface 95 of the outer section 90 form a rib 124 on the second surface 97 of the outer section 90. It will be appreciated that the ribs 124 strengthen the outer section 90, permitting the deflector 30 to withstand the impact of large or heavy loads of snow.

Each recess 112 is preferably U-shaped, defined by interior and exterior side walls 125 and 126 and a substantially planar bottom 128. An outer surface 130 of the bottom 128 is configured to engage the mounting surface 66 of the snow plow blade 32. An inner surface 131 of the bottom 128 is configured to engage the center section 94, as will be described in more detail below. As will be appreciated by those skilled in the art, the recesses 112 can have a different overall shape, such as a generally circular shape, provided each recess includes a bottom surface configured to mate with and engage the mounting surface 66 of the snow plow blade 32.

An aperture 132 is formed in the bottom 128 of each recess 112 to accommodate a bolt 134 or other fastening mechanism so that the outer section 90 can be secured to the top member 44 of the snow plow blade 32. The aperture 132 is positioned within each recess 112 so that it can be coaxially aligned with the apertures 82 on the mounting surface 66 of the top member 44 of the snow plow blade 32.

The outer section 92 is formed in the same manner as the outer section 90, and therefore has a generally arcuate cross section, including first and second surfaces 140 and 142, a width 144 defined by first and second side ends 146 and 148, a forward edge 150, having a downwardly angled position and a rear edge 152 including a downwardly extending lip 154. A plurality of downwardly sloping channels 156 and a corresponding plurality of mounting elements 158, such as recesses, are formed in an evenly spaced manner along the entire width 144 of the outer section 92 between the ends 146 and 148 thereof. As illustrated in FIGS. 3 and 4, each channel 156 is adjacent to one of the recesses 158.

Each channel 156 includes first and second side walls 160 and 162 that slope downwardly toward the rear edge 152 and a ramp portion 164. As best illustrated in FIGS. 7, 12 and 16, each of the channels 156 in the first surface 140 of the outer section 92 form a rib 166 on the second surface 142 of the outer section 92. It will be appreciated that the ribs 166 strengthen the outer section 92 to permit the deflector 30 to withstand heavy or large loads of snow.

Each recess 158 is preferably U-shaped having interior and exterior side walls 168 and 170 and a substantially planar bottom 172. An outer surface 174 of the bottom 172 is configured to engage the mounting surface 66 of the top member 44. An inner surface 175 of the bottom 172 is configured to engage the center section 94, as will be described in more detail below. As will be appreciated by those skilled in the art, the recesses 158 can have another overall shape, such as a generally circular, provided each recess includes a bottom surface configured to mate with and engage the mounting surface 66 of the snow plow blade 32.

An aperture 176 is formed through the bottom 172 of each recess 158 to accommodate the bolt 134 or so that the outer section 92 can be secured to the top member 44 of the snow plow blade. The aperture 176 is positioned within the recess 158 on the outer section 92 so that it can be aligned with the apertures 82 on the mounting surface 66 of the snow plow blade 32.

Figure 13:
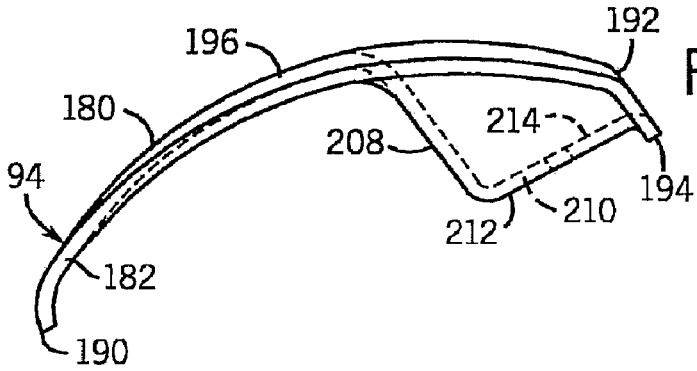
FIG. 13 is a side view of a center section of the snow plow deflector illustrated in FIGS. 1 through 11.

As best illustrated in FIGS. 4, 13 and 16, the center section 94 has a generally arcuate cross section of substantially the same shape as the outer sections 90 and 92. The center section 94 has first and second surfaces 180 and 182, a width 184 defined by first and second side ends 186 and 188, a forward edge 190, having a downwardly angled position and a rear edge 192 including a downwardly extending lip 194. A plurality of raised ribs 196 and a corresponding plurality of mounting elements 198, such as recesses, are formed in an evenly spaced manner along the entire width 184 of the center section 94 between the ends 186 and 188 thereof. As illustrated in FIG. 4, each rib 196 is adjacent to one of the recesses 198.

Figure 8:
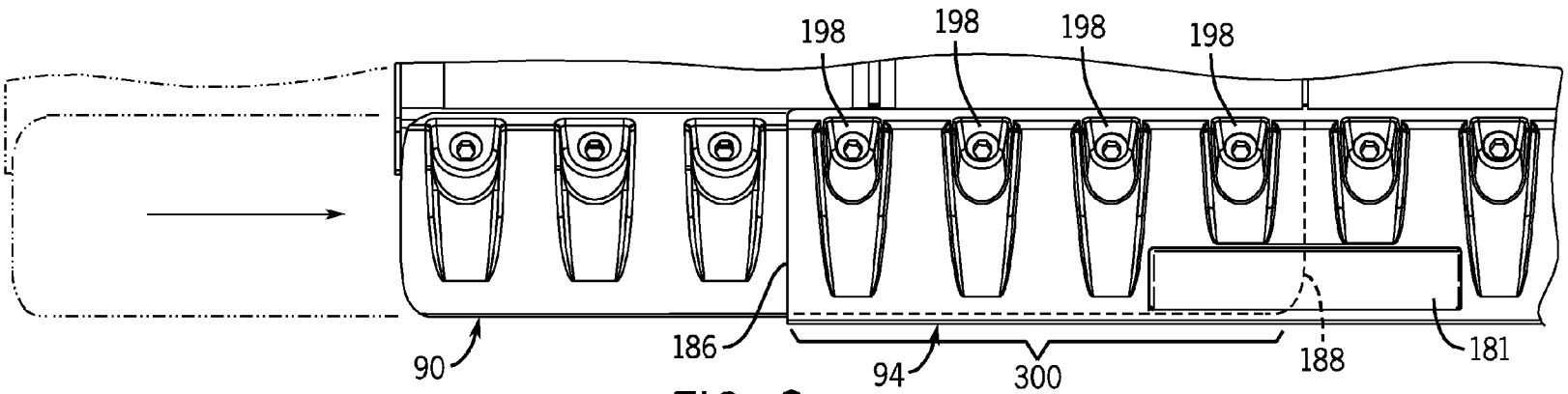
FIG. 8 is a top cutaway view of the snow deflector illustrated in FIGS. 1 through 7, showing the outer sections and center section of the snow deflector assembled together, wherein the center section overlaps a second portion of each center section.

Each raised rib 196 begins near the forward edge 190 of the center section 94 and includes first and second side walls 200 and 202 and a raised middle portion 204 that each curve downwardly toward the rear edge 192. As illustrated in FIGS. 4 and 8, each of the first and second side walls 200 and 202 extend downward on opposite sides of the recess 198. It will be appreciated that the ribs 196 strengthen the center section 94 to permit the deflector 30 to withstand the impact of large or heavy loads of snow.

Each recess 198 is preferably U-shaped and is sized to fit within the recesses 112 and 158 formed in the outer sections 90 and 92, respectively. Each recess is defined by interior and exterior side walls 206 and 208 and a substantially planar bottom 210. An outer surface 212 of the bottom 210 is configured to engage the mounting surface 66 of the top member 44, and also configured to engage the inner surfaces 131 and 175 of the recesses 112 and 158 of each of the outer sections 90 and 92, respectively, when deflector 30 is installed on the snow plow blade 32. The bottom 210 of the center section 94 also includes an inner surface 214.

An aperture 216 is formed through the bottom 210 of each of the recesses 198 to accommodate the bolt 134. As will be appreciated, the apertures 216 are positioned within each of the recesses so it can be aligned with the apertures 132 and 176 in the outer sections 90 and 92, respectively, and also with the apertures 82 on the mounting surface 66 of the snow plow blade 32 when the deflector 30 is installed thereon.

The first surface 180 of the center section 94 can include an area 181 for displaying manufacturer, trademark and/or model information for the snow deflector 30.

Turning next to FIGS. 3, 4 and 14 through 17, assembly of the snow deflector 30 of the present invention on to the straight snow plow blade 32 is illustrated. The snow plow blade 32 is first lowered to a flat, level surface. The outer section 90 is then positioned with its second surface 97 facing the plowing side 42 of the snow plow blade. The first end 100 of the outer section 90 is aligned with the first side end 70 of the mounting surface 66 of the snow plow's top member 44. In addition, the outer member 90 is positioned so that the outer surface 130 of the bottom 128 of each of the recesses 112 engages and rests flush against the mounting surface 66, with the lip 108 extending downwardly over the rear surface 68 of the top member 44 of the snow plow blade 32.

The outer section 90 can be adjusted in either direction along the width 38 of the snow plow blade 32 so that each of the apertures 132 formed in the bottom 128 of each recess 112 are coaxially aligned with the apertures 82 in the mounting surface 66 of the snow plow blade 32. Once the outer section 90 is in its proper position, it is preferably temporarily clamped in placed, while the remaining sections 92 and 94 of the deflector 30 are positioned.

Likewise, the outer section 92 is positioned with its second surface 142 facing the plowing side 42 of the snow plow blade 32. The first end 146 of the outer section 92 is aligned with the second side end 72 of the mounting surface 66 of the snow plow's top member 44. In addition, the outer member 92 is positioned so that the outer surface 174 of the bottom 172 of each of the recesses 158 engages and rests flush against the mounting surface 66, with the lip 154 extending downwardly over the rear surface 68 of the top member 44 of the snow plow blade 32.

The outer section 92 can be adjusted in either direction along the width 38 of the snow plow blade 32 so that each of the apertures 176 formed in the bottom 172 of each recess 158 are coaxially aligned with the apertures 82 in the mounting surface 66 of the snow plow blade 32. Once the outer section 92 is in its proper position, is preferably temporarily clamped in placed, while the center section 94 of the deflector 30 is positioned.

As illustrated in FIGS. 4 through 9, when the outer sections 90 and 92 are in place, a portion 228 of the top member 44 of the straight snow plow blade 32 may not be covered by the outer sections 90 and 92 of the deflector 30. Accordingly, as shown in FIG. 4, the center section 94 is positioned over the portion 228 of the plow blade 32 and over the top of both the outer sections 90 and 94, so that its side end 186 overlaps a portion 232 of the outer section 90, and its side end 188 overlaps a portion 234 of the outer section 92.

When properly positioned, the recesses 198 near the end 186 of the center section 94 interfit and seat flush within the recesses 112 in the overlapping portion 232 of the outer section 90. In addition, the apertures 216 in the bottom 210 of each seated recess 198 of the center section 94 are coaxially aligned with the apertures 132 in the bottom 128 of the outer section 90, and in turn, coaxially aligned with the apertures 82 in the mounting surface 66 of the top member 44 of the blade frame 40.

Likewise, the recesses 198 near the end 188 of the center section 94 interfit and seat flush within the recesses 158 in the overlapping portion 234 of the outer section 92. In addition, the apertures 216 in the bottom 210 of each seated recess 198 of the center section 94 are coaxially aligned with the apertures 176 in the bottom 172 of the outer section 92, and in turn coaxially aligned with the apertures 82 in the mounting surface 66 of the top member 44 of the blade frame 40.

Figure 6:
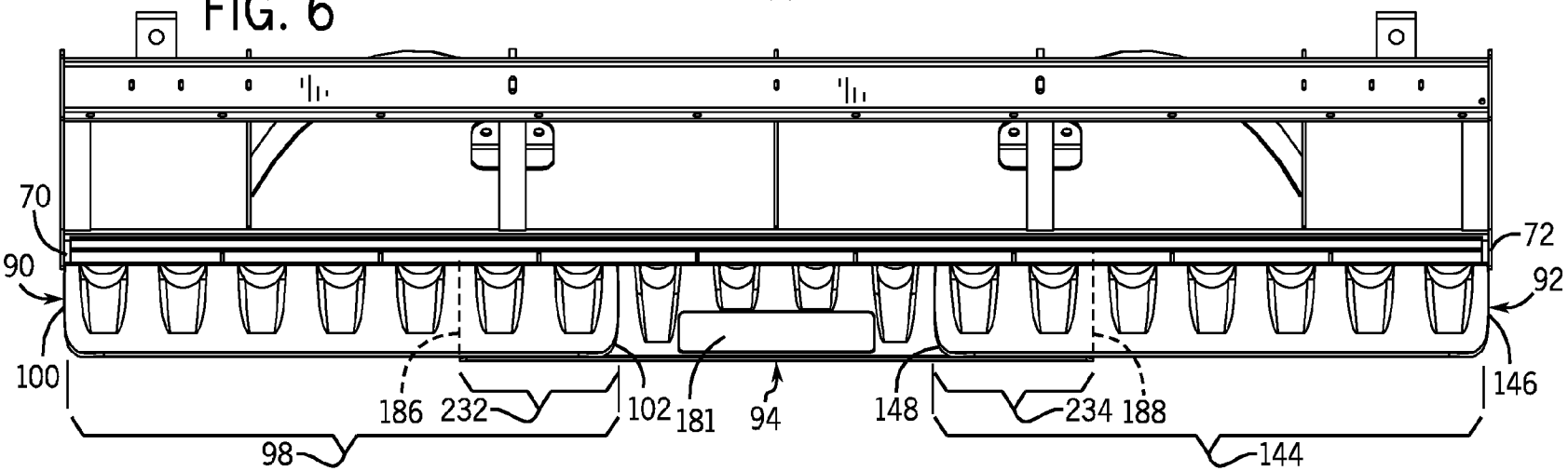
FIG. 6 is a top cutaway view of the snow deflector illustrated in FIGS. 1 through 5, showing the outer sections and center section of the snow deflector assembled together, wherein the center section overlaps a first portion of each center section.

As illustrated in FIGS. 5 and 6, two recesses 198 on the end 186 of the center section 94 overlap and seat within the two recesses 112 on the overlapping portion 232 of the outer section 90, and two recesses 198 on the end 188 of the center section 94 overlap and seat within two corresponding recesses 158 on the overlapping portion 234 of the outer section 92.

The center section 94 also overlaps the portion 228 of the top member 44 of the straight snow plow blade 32 so that the outer surface 212 of the bottom 210 engages and rests flush against the mounting surface 66 thereof, with the lip 194 extending downwardly over the rear surface 68 of the top member 44 of the snow plow blade 32.

The bolts 132, and preferably washers 230, are then used to secure the deflector 30 to the snow plow blade 32. As best illustrated in FIG. 3, the first end 100 of the outer section 90 is secured to the snow plow blade 32 by threading one of the bolts 132 consecutively through the aperture 132 in the bottom 128 of each recess 112 and then through the corresponding aperture 82 in mounting surface 66 of the snow plow blade 32. Likewise, the first end 146 of the outer section 92 is secured in place by threading one of the bolts 132 consecutively through each of the apertures 176 in the bottom 174 of each recess 158 and then through the corresponding aperture 82 in mounting surface 66 of the snow plow blade 32.

The center section 94 is secured in place by threading one of the bolts 132 consecutively through the aperture 216 in the bottom 210 of the recess 198, through the corresponding, coaxially aligned aperture 132 in the bottom 128 of each recess 112 of the overlapping portion 232 of the outer section 90, and then through the corresponding, coaxially aligned aperture 82 in mounting surface 66 of the snow plow blade 32. Likewise, one of the bolts 132 is threaded consecutively through the aperture 216 in the bottom 210 of the recess 198, through the corresponding, coaxially aligned aperture 176 in the bottom 172 of each recess 158 of the overlapping portion 234 of the outer section 92, and then through the corresponding, coaxially aligned aperture 82 in mounting surface 66 of the snow plow blade 32.

The center section 94 is directly secured to the portion 228 of the top member 44 of the straight snow plow blade 32 by threading one of the bolts 132 through the aperture 216 in the bottom 210 of the recess 198, and then through the corresponding, coaxially aligned aperture 82 in mounting surface 66 of the snow plow blade 32.

Figure 9:
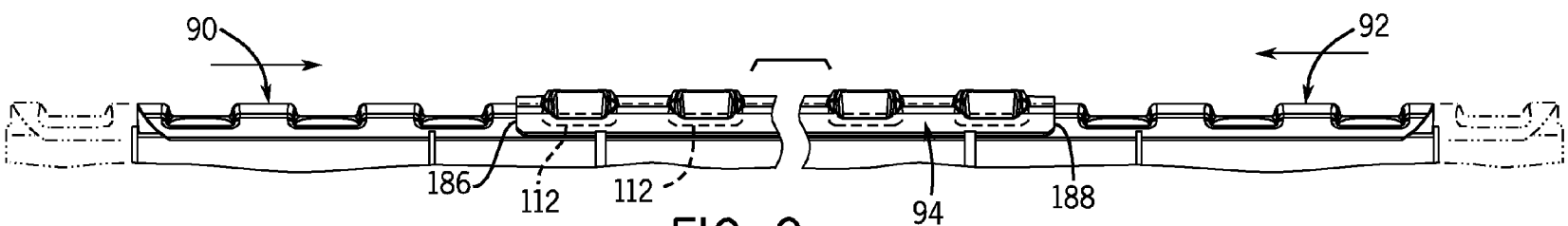
FIG. 9 is a partial side view of the snow deflector illustrated in FIGS. 1 through 8, demonstrating adjustability of the snow plow deflector for different widths of snow plow blades.
Figure 10:
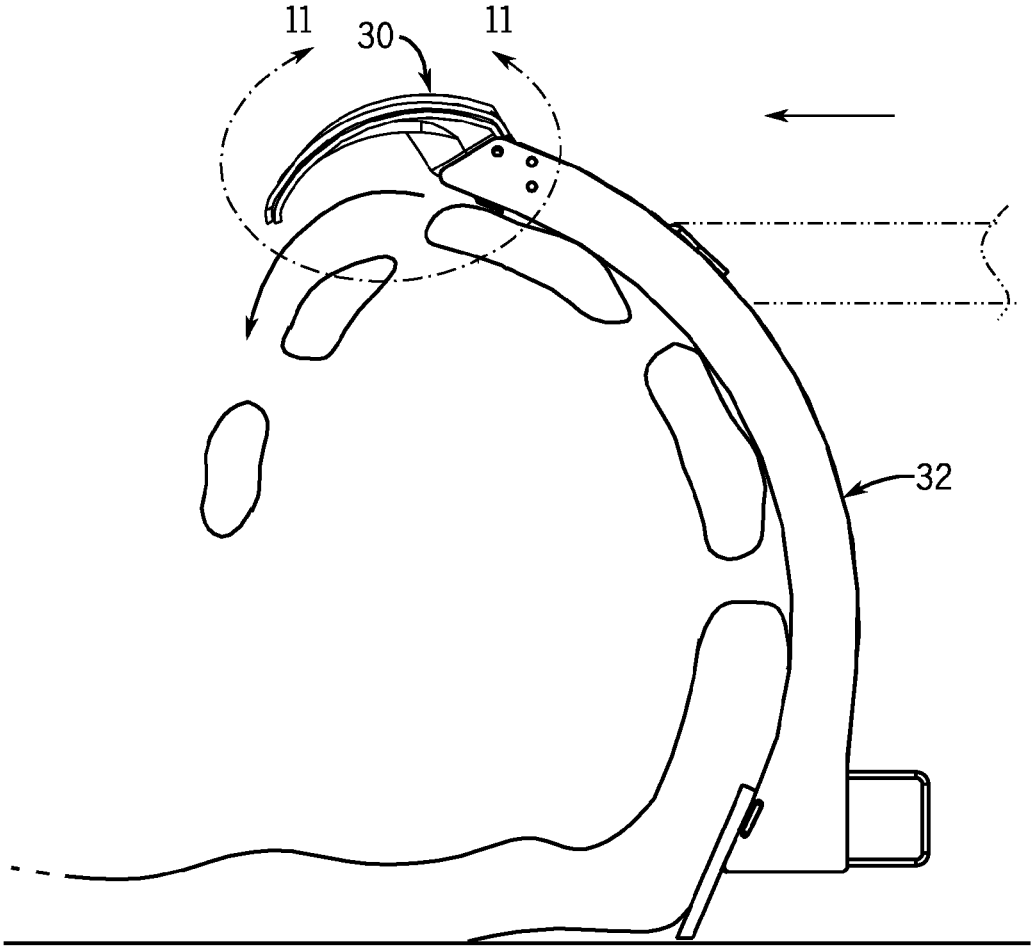
FIG. 10 is a side view of the snow deflector illustrated in FIGS. 1 through 9, mounted to a snow plow blade, illustrating deflection of snow outward and downward from the snow plow blade.
Figure 11:
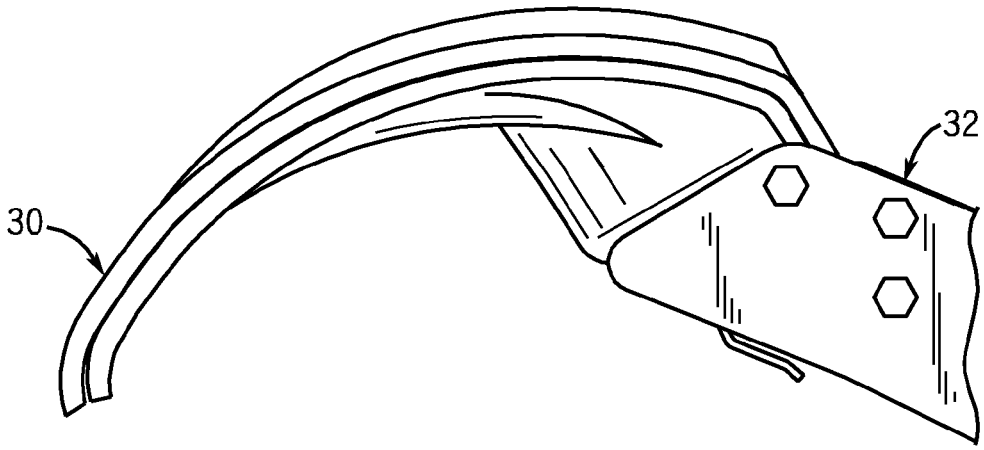
FIG. 11 is partial view of the snow plow deflector mounted to a snow plow blade illustrated in FIG. 10 taken along the line 11-11.

As best illustrated in FIGS. 8 and 9, the deflector 30 is adjustable to straight snow plow blades of different widths 38. For example, the snow plow blade 32 shown in FIGS. 8 and 9 is shorter than the blade shown in FIG. 5, and as such, the end 186 center section 94 overlaps a larger portion 300 of the of the outer section 90 so that four recesses 198 thereon seat within the four corresponding, and aligned recesses 112 on the outer section 90. Likewise, the end 188 of the center section 94 overlaps a larger portion 302 of the outer section 92 so that four recesses 198 thereon seat within the four corresponding, and aligned recesses 158 on the outer section 92. It is preferable that each end 186 and 188 of the center section 94 overlap the same number of recesses on the outer sections 90 and 92, respectively. However, it is consistent with the broader aspects of the present invention that each end 186 and 188 of the center section 94 can overlap a different number of recesses on the outer sections 90 and 92, respectively, depending on the width 38 of the snow plow blade 32.

Consistent with the broader aspects of the present invention, the center section 94 of the deflector 30 can be secured to the snow plow blade 32 underneath the outer sections 90 and 92, respectively, so that the portion 232 of the outer section 90 overlaps the end 186 of the center section 94, and the portion 234 of the outer section 92 overlaps the end 188 of the center section 188. One skilled in the art will recognize that when configured to mount this way, each recess of the outer sections will be sized to interfit and seat flush within the recesses 198 provided on the center section 94.

The snow plow snow deflector of the present invention is of a construction which is both durable and long lasting, and which will require little or no maintenance to be provided by the user throughout its operating lifetime. The snow plow snow deflector is also of inexpensive construction to enhance its market appeal and to thereby afford it the broadest possible market. Finally, all of the aforesaid advantages and objectives of the snow plow snow deflector of the present invention are achieved without incurring any substantial relative disadvantage.

Although the foregoing description of the snow plow snow deflector wings of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A snow deflector configured to attach to a top member of a snow plow blade, the snow deflector comprising:

a first arcuate member having first and second ends and a width therebetween, a forward edge and a rear edge, the rear edge of the first arcuate member including a plurality of evenly spaced recesses formed along the width thereof, each recess including a substantially planar mounting surface configured to engage the top member of the snow plow blade, each mounting surface including an aperture formed therein;

a second arcuate member having first and second ends and a width therebetween, a forward edge and a rear edge, the rear edge of the first arcuate member including a plurality of evenly spaced recesses formed along the width thereof, each recess including a substantially planar mounting surface configured to engage the top member of the snow plow blade, each mounting surface including an aperture formed therein; and a center arcuate member having first and second ends and a width therebetween, a forward edge and a rear edge, the rear edge of the center arcuate member including a plurality of evenly spaced recesses formed along the width thereof, each recess including a substantially planar mounting surface configured to seat flush against the mounting surfaces of each of the first and second arcuate members, each mounting surface including an aperture formed therein;

wherein the center arcuate member is positioned between the first and second arcuate members, such that at least one of the recesses on the first end of the center section seats within at least one recess formed in the first end of the first arcuate member and at least one of the recesses in the second end of the center arcuate member seats within at least one recess the first end of the second arcuate member.

2. The snow deflector according to claim 1, wherein each of the first and second arcuate members and the center arcuate member are constructed of a thermoplastic material.

3. The snow deflector according to claim 2, wherein the thermoplastic material is selected from polypropylene, polyethylene, polystyrene, silicones, polyurethanes, acrylics, rubber, synthetic rubber, neoprene, or combinations thereof.

4. The snow deflector according to claim 1, wherein each of the recesses in the first and second arcuate members and the recesses in the center arcuate member are substantially U-shaped.

5. The snow deflector according to claim 1, wherein each of the first and second arcuate members and center arcuate member is secured to the top member of the snow plow blade using bolts threaded through each of the apertures, respectively.

6. The snow deflector according to claim 1, wherein at least two of the recesses on the first end of the center section seat within at least two recesses formed in the first end of the first arcuate member and at least two recesses in the second end of the center arcuate member seat within at least two recesses in the first end of the second arcuate member.

7. A snow deflector having an adjustable width and configured to mount to a top member of a straight snow plow blade, the snow deflector comprising:

first, second and third deflector components, each of the first, second and third deflector components having a forward edge, a rear edge, opposing side ends and a width therebetween, wherein each of the first, second and third deflector components include a plurality of recessed portions presenting a mounting surface configured to engage the top member of the snow plow blade, each of said recessed portions includes an aperture for mounting the deflector to the top member of the snow plow blade, wherein the first, second and third deflector components are configured to overlap each other, wherein the deflector is a first width when each of the ends of the second deflector component overlap and engage a first number of recessed portions on each of the first and third deflector components, and a second width when each of the ends of the second deflector component overlap and engage a second number of recessed portions on each of the first and third deflector components.

8. The snow deflector according to claim 7, wherein the first, second and third deflector components are each generally arcuate in shape.

9. The snow deflector according to claim 7, wherein each end of the second deflector component overlies a portion the first and third deflector components, respectively.

10. The snow deflector according to claim 7, wherein each of the first and third deflector components include a portion that overlies the second deflector component.

11. The snow deflector according to claim 7, wherein each of the recessed portions in the first, second and third deflector components are substantially U-shaped.

* * * * *

UNITED STATES PATENT AND TRADEMARK OFFICE
Certificate

Patent No. 7,721,471 B2 Patented: May 25, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert N. Gamble, II, Watertown, WI (US); and Mike Stevens, Cedarburg, WI (US).

Signed and Sealed this Eleventh Day of June 2013.

THOMAS B. WILL
*Supervisory Patent Examiner*
Art Unit 3671
Technology Center 3600